US008437628B1

(12) United States Patent
Lin et al.

(10) Patent No.: US 8,437,628 B1
(45) Date of Patent: May 7, 2013

(54) METHOD AND APPARATUS OF HEAT TREATING AN INTEGRALLY BLADED ROTOR

(75) Inventors: Wangen Lin, South Glastonbury, CT (US); James J. Moor, New Hartford, CT (US); Thomas DeMichael, Stafford Springs, CT (US); Herbert A. Chin, Portland, CT (US); Melissa R. Hill, Manchester, CT (US); Michael J. Labbe, Hebron, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 13/361,283

(22) Filed: Jan. 30, 2012

Related U.S. Application Data

(63) Continuation-in-part of application No. 13/184,733, filed on Jul. 18, 2011.

(51) Int. Cl.

| | |
|---|---|
| ***B21D 53/78*** | (2006.01) |
| ***F27B 5/14*** | (2006.01) |
| ***F27D 7/06*** | (2006.01) |
| ***F27D 11/02*** | (2006.01) |

(52) U.S. Cl.
USPC ..... 392/419; 392/420; 392/423; 392/424; 29/889.7

(58) Field of Classification Search ..... None
See application file for complete search history.

(56) References Cited

U.S. PATENT DOCUMENTS

| | | | | |
|---|---|---|---|---|
| 3,654,471 | A * | 4/1972 | Nilsson | 250/505.1 |
| 6,242,717 | B1 * | 6/2001 | Sanderson | 219/405 |
| 7,595,464 | B2 * | 9/2009 | Konishi | 219/216 |
| 7,775,690 | B2 * | 8/2010 | Wakalopulos | 362/346 |
| 2006/0022154 | A1 * | 2/2006 | Schmitkons et al. | 250/495.1 |
| 2007/0047932 | A1 * | 3/2007 | Caldwell et al. | 392/419 |
| 2009/0020523 | A1 * | 1/2009 | DeMichael et al. | 219/553 |

FOREIGN PATENT DOCUMENTS

| | | | |
|---|---|---|---|
| DE | 10055877 | C1 * | 5/2002 |
| JP | 2007229792 | A * | 9/2007 |

* cited by examiner

*Primary Examiner* — Joseph M Pelham
(74) *Attorney, Agent, or Firm* — Kinney & Lange, P.A.

(57) ABSTRACT

A process for heat treating selected portions of an integrally bladed rotor (IBR) having a plurality of blades, the process using an IBR on a fixture having a rotor engaging portion that moves the IBR into an environmental chamber. An IR heater is placed on one of the IBR blades and heat treated after air has been removed from the chamber and an inert gas is added. The IR heater is lifted from the blade and indexed to position another blade on the IBR. The process is repeated until all the IBR blades are heat treated.

20 Claims, 6 Drawing Sheets

METHOD AND APPARATUS OF HEAT TREATING AN INTEGRALLY BLADED ROTOR

CROSS-REFERENCE TO RELATED APPLICATION(S)

This invention is a continuation in part of an application titled Local Heat Treatment of IBR Blade Using Infrared Heating, filed Jul. 18, 2011 and having Ser. No. 13/184,733, the disclosure of which in incorporated by reference in its entirety.

STATEMENT OF GOVERNMENT INTEREST

This invention was made with government support under F33657-03-D-0016 0010 awarded by the United States Air Force. The government has certain rights in the invention.

BACKGROUND

Heat treatment of integrally bladed rotors (IBR) or bladed disks (blisk) is required to obtain appropriate material properties and to relieve residual stresses due to fusion welding processes such as, for example, electron beam welding, laser welding, or arc welding, as well as solid state bonding processes such as linear friction welding.

Heat treatment is typically performed by exposing the entire IBR or a portion of the IBR (e.g. the weld region) to a predetermined thermal cycle. The technique of heat treating the entire IBR is commonly known in the art of IBR manufacture.

During blade repair operations, it may be necessary to locally heat treat the repaired areas of the integrally bladed rotors that have been exposed to elevated temperatures resulting from repair operations. In the finished machine condition, conventional heat treatment is not always possible due to concerns with part distortion. Additional risk factors for conventional heat treatment, of a repaired finished machined integrally bladed rotor are, (a) it may create unnecessary risk due to the potential for surface contamination throughout the entire part and (b) some areas of the IBR should not be exposed to additional temperature exposure that results in material property debit. Because of these concerns, local heat treatment has been considered to be a preferred option.

IBRs are typically made of either titanium alloys such as Ti-6-4, Ti-6-2-4-2, Ti-6-2-4-6 alloys or nickel based alloys such as Alloy 718 alloy or IN-100. The IBR is a critical rotating component within an engine, and the engineering, materials, manufacturing, and quality requirements are extremely rigorous.

There are two major technical challenges associated with the local heat treatment of an IBR, in addition to the business challenge that the manufacturing process be affordable. First, the selected portion of the IBR receiving heat treatment must meet a prescribed thermal cycle and the remaining IBR component must not be exposed to temperatures that exceed a specific peak temperature to ensure that the material properties meet engineering requirements. Second, the selected portion of the IBR receiving localized heat treatment must be protected from oxidation due to exposure to high temperature.

SUMMARY

The present invention comprises a process and system for using a directional (focused) infrared (IR) heater to heat treat specific areas on the blades of IBR devices using a holding fixture for mounting the IBR, an environmental chamber for performing the heat treatment, a heater support unit that positions the heater on the IBR blades, and a control unit for precisely indexing the support unit on to successive blades until all the repaired blades are heat treated.

This heat treatment is done using a heater that is capable of placement of infrared heat sources on the individual integral blades in an inert environment which in one form uses parabolic minors to focus heat only onto the desired area.

DETAILED DESCRIPTION

Figure 1:
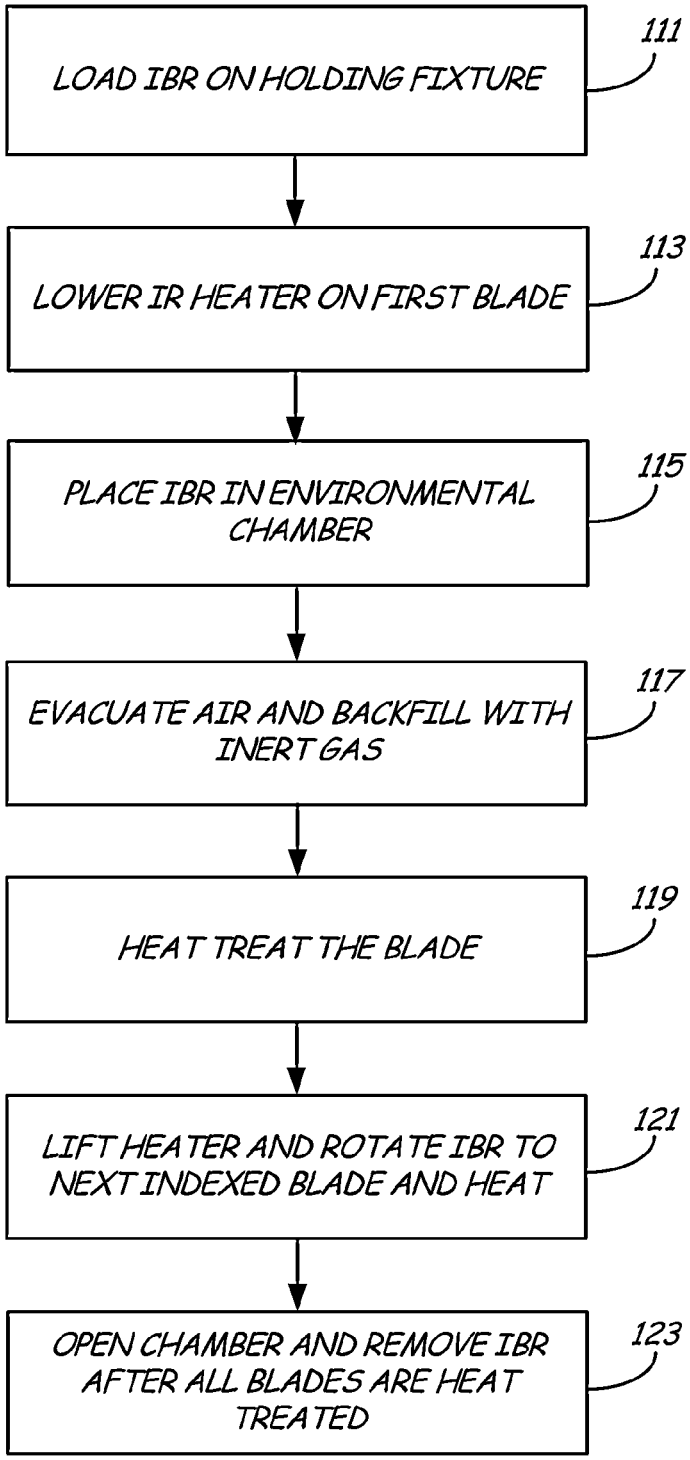
FIG. 1 is a block diagram showing the process of this invention.

The process of this invention provides for localized heat treatments for integrally bladed rotors (IBR) as shown in FIG. 1. The IBR to be treated is loaded on a holding fixture as seen in step 111. The heater support unit is mounted onto the IBR holding fixture and the IR heater is lowered on to the first blade of the IBR in step 113. The IBR is then placed in an environmental chamber in step 115. The chamber is closed, evacuated and backfilled with an inert gas such as, for example, argon or helium in step 117. The selected blade is heat treated in step 119. In step 121, the heater is lifted, the IBR is indexed to present the next repaired blade, the heater is lowered and that blade is heat treated. Step 121 is repeated so that all of the individual repaired blades on the IBR are heat treated. Once this is done, the chamber is opened and the IBR is removed, as noted in step 123.

Figure 2A:
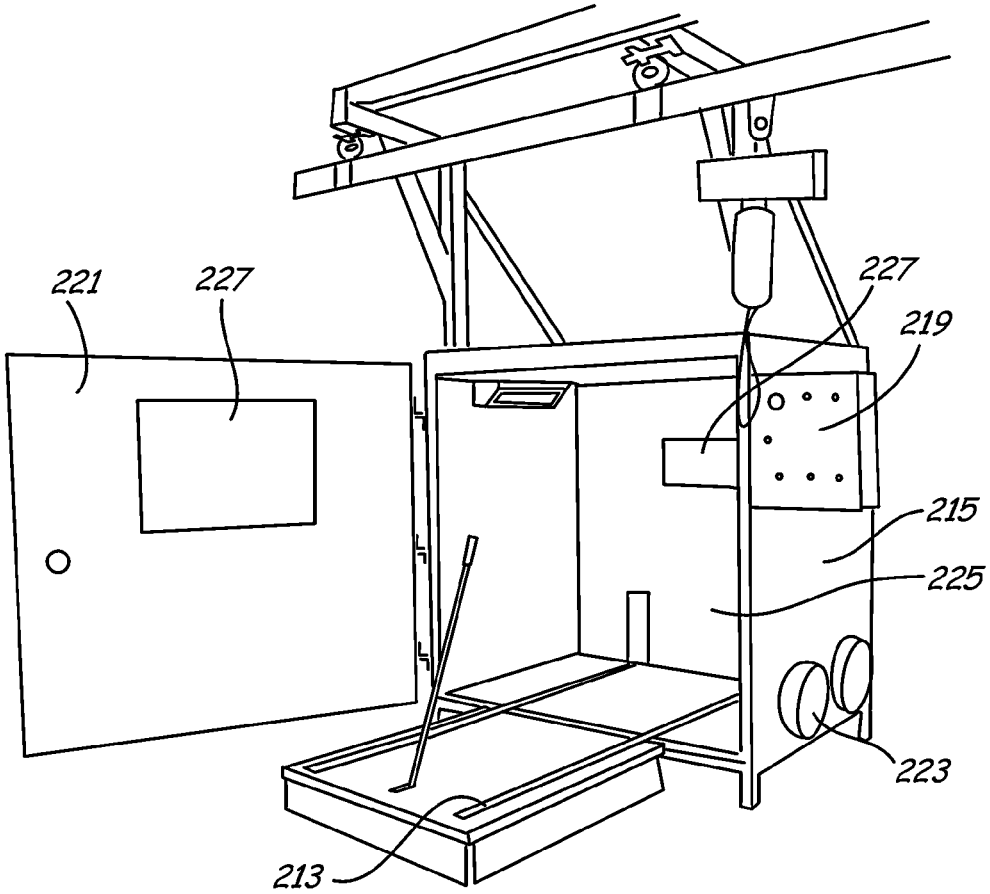
FIG. 2A is a perspective view of the environmental chamber of this invention.
Figure 2B:
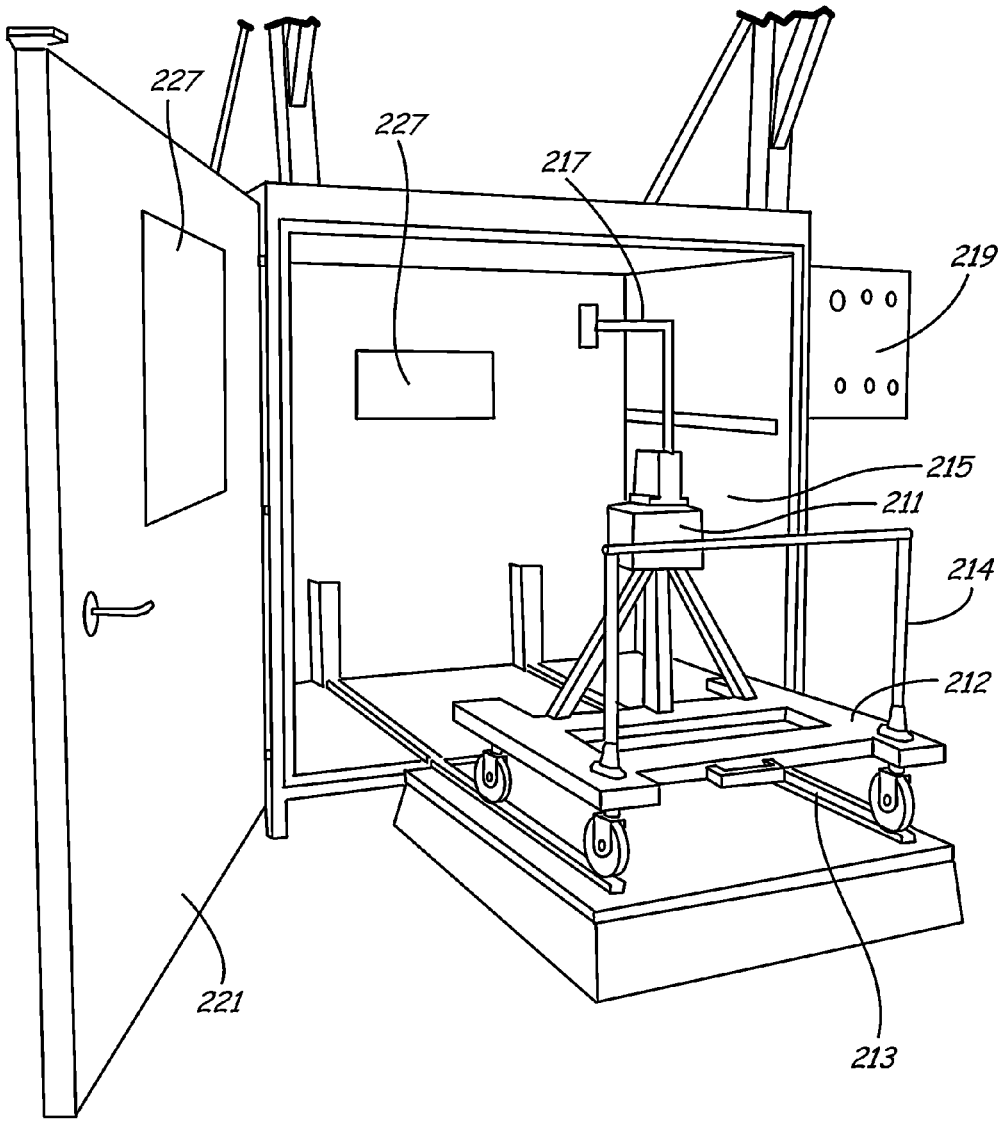
FIG. 2B is a perspective view of the mounting fixture of this invention.
Figure 3:
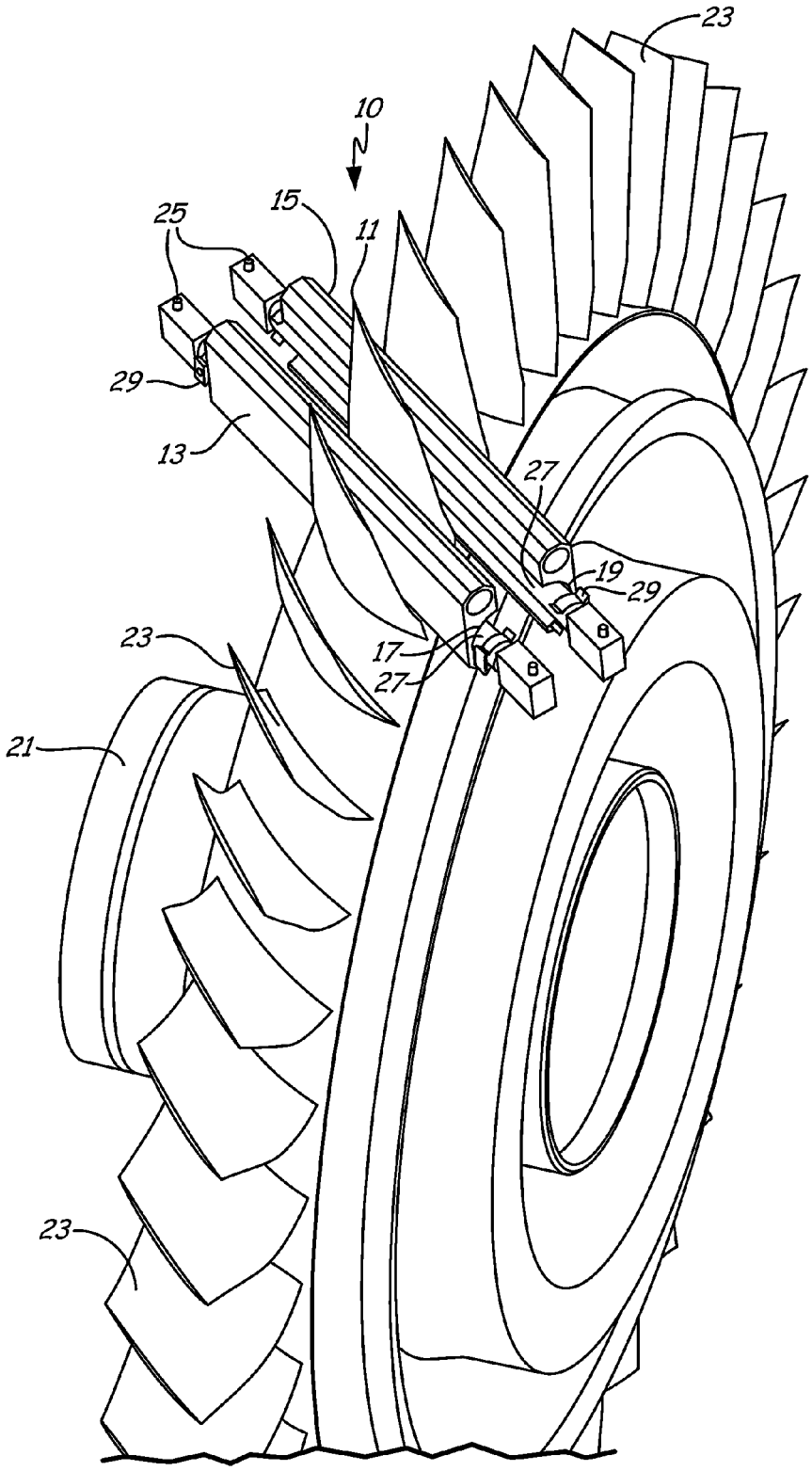
FIG. 3 is a perspective view showing the IR heater of this invention.

FIGS. 2A and 2B illustrate a device for carrying out the process of this invention as shown in FIG. 1. An IBR, 21, shown in FIG. 3 is placed on a mounting fixture 211 in FIG. 2B. Heater 10 generally in FIG. 3 is lowered on to a first selected blade 11 by heater support unit 217 using control panel 219.

Loaded mounting fixture 211 is placed on tracks 213 and is moved into environmental chamber 215. Tracks 213 can be configured in other manners as long as it is capable of moving mounting fixture 211 into and out of chamber 215 as needed.

Door 221 is closed and chamber 215 is evacuated via vent 223. Both door 221 and back wall 225 of chamber 215 have windows 227 so the operation can be observed as heater 10 is lowered on to successive blades 23 of FIG. 3.

The process and system of this invention provides a means for critical hardware such as IBR units to receive the desired thermal cycle at the specific location where it is needed. An indexing component of the process and system treats every blade without opening the chamber. The heat treatment takes place in a protective environment to avoid formation of undesirable constituents such as alpha case. The process and system of this invention is suitable for OEM manufacture and for repair of existing IBR systems.

Figure 4:
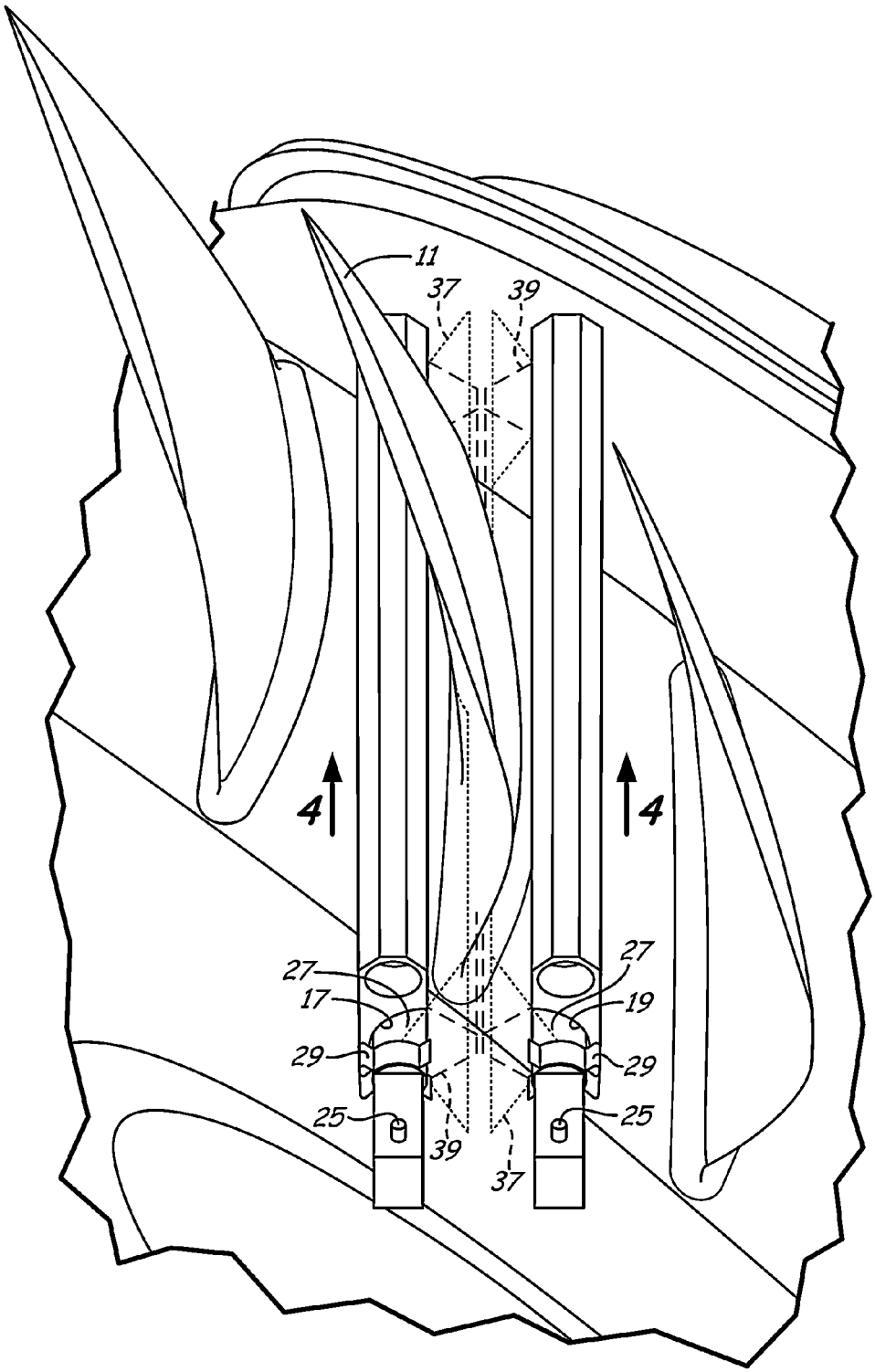
FIG. 4 is a plan view showing the device of this invention focused on a single integrally bladed rotor.

Heater 10 is described in the co-pending application identified in paragraph [0001] above. In addition other heaters having other designs may be used. It is necessary that the heater be able to be placed on and removed from each IBR blade as the blades are sequentially indexed. The heater must be able to heat treat the desired region of each blade without allowing undesired heat to affect the remaining portion of the blade. Following is a description of FIGS. 3-5 from the above identified parent application.

Device 10 is positioned proximate an integrally bladed rotor (IBR) airfoil 11 for heating a portion of the IBR airfoil 11 and thereby eliminate overall part exposure to heat. Device 10 includes a pair of infrared (IR) lamp housings 13 and 15, each with an IR lamp generating IR rays that are reflected off parabolic mirrors 17 and 19, respectively, to contact IBR 11 and heat treat that blade without exposing any other part of IBR airfoil 11 to unwanted heat.

FIG. 3 illustrates a complete integrally bladed rotor with rotor hub 21 supporting a plurality of other airfoils 23. Device 10 is positioned on airfoil 11 and includes electrical contacts 25 connected to a power source, not shown, for actuation of IR lamps 27 that are held in place by clips 29. Rays from IR lamps 27 are focused by minors 17 and 19 as an elongated band of IR radiation on a specific portion of airfoil 11, in this instance the portion of airfoil 11 attached to rotor hub 21. The width of the band of focused IR radiation may be any width that permits complete heat treatment of the desired portions of the component. Band widths may range from about 6 mm to about 18 mm, and may be about a 12 mm band width. Other widths may also be accommodated depending on, for example, the size of the parts, the material being heat treated Device 10 also includes tubes or passages 33, shown more clearly in FIG. 5, that are connected to a source of water or other cooling medium, not shown, to cool portions of device 10 to prevent distortion and a resulting uneven heating. Other cooling devices such as fans and refrigerants may also be used.

Figure 5:
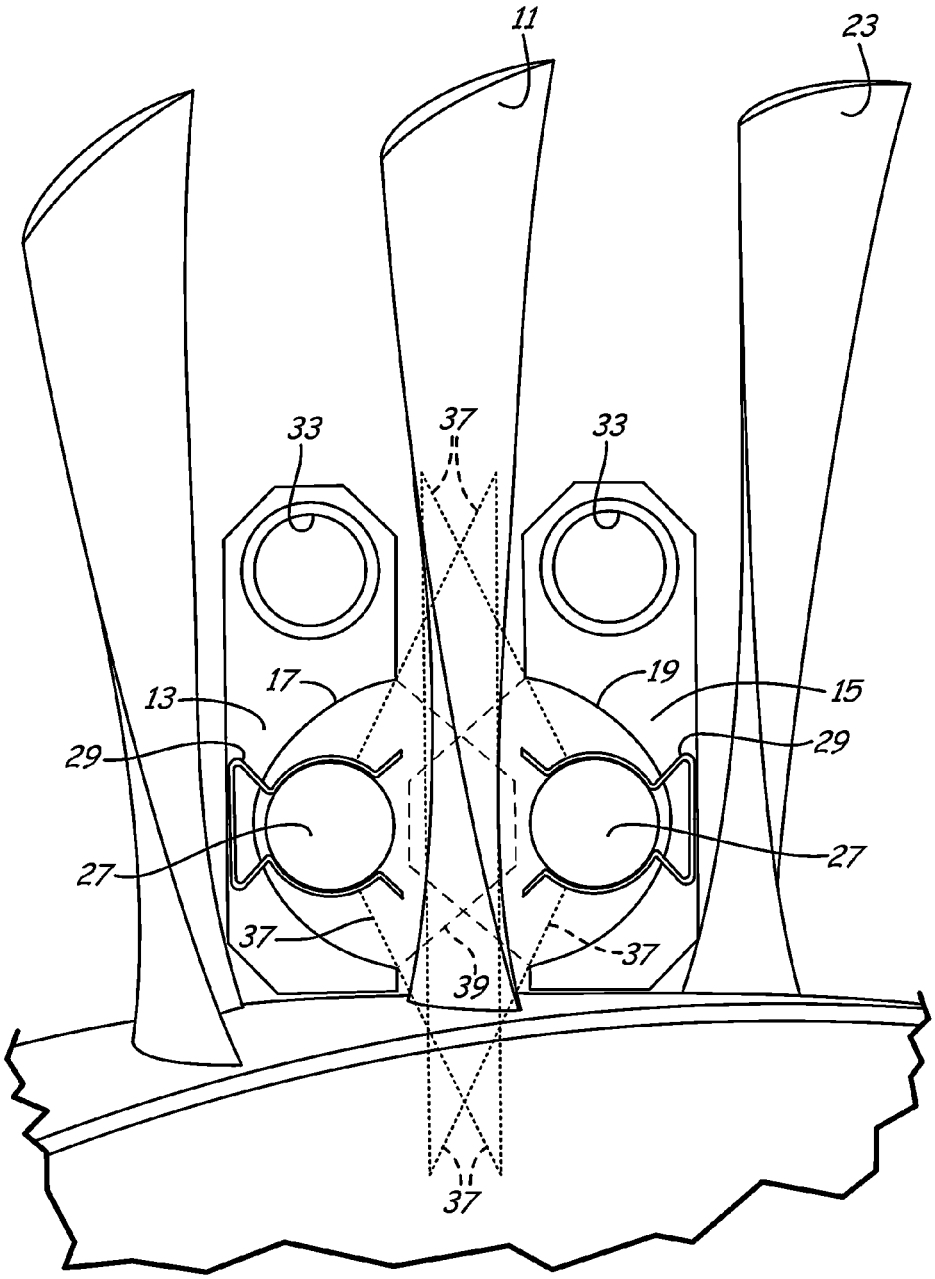
FIG. 5 is a section view taken along line 4-4 of FIG. 4.

Also shown in FIG. 5 are dotted lines 37 that represent the extent of unfocused IR rays from lamps 27, and dashed lines 39 represent the extent of IR rays focused by minors 17 and 19 onto the portion of airfoil 11 that is to be heat treated, such as to relieve stress in the metal after welding airfoil 11 to rotor hub 21.

It is known that heat treatment in the presence of oxygen can cause titanium alloys to become embrittled if the temperature exceeds 1,000° F. (538° C.). In addition to embrittlement, the material properties of titanium alloys changes if it is exposed to a temperature exceeding 800° F. (427° C.), but as will be understood the actual temperature depends on the specific alloy. Oxygen contamination at referenced temperatures can be avoided by proper protection such as the use of inert shielding gas such as argon and helium. The present invention ensures that the portion(s) of the product being treated will receive desired thermal treatment but generally remain below 1,000° F. (538° C.) and even below 800° F. (427° C.).

The present invention was used to heat treat and stress relieve a plurality of IBR blades without adversely heating other critical areas of the IBR. In addition, replacement blades have been attached to an IBR by focusing the heat only at the desired location, e.g., where the replacement blade is attached to the IBR. The device of this invention is suitable for OEM manufacture and for repair of existing IBR systems.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A process for heat treating selected portions of an integrally bladed rotor (IBR) having a plurality of blades, the process comprising:

mounting an IBR on a fixture having a rotor engaging portion;

mounting an IR heater on one of the IBR blades;

moving the fixture having an IBR into an environmental chamber;

evacuating air from the chamber and adding an inert gas;

heat treating the blade having the IR heater;

lifting the IR heater from the blade and indexing the IBR to position another blade in alignment with the IR heater;

mounting the IR heater on the another blade and heat treating the another blade, repeating the steps including indexing and heat treating of the IBR blades until all its blades are heat treated; and removing the IBR from the chamber.

2. The process of claim 1, wherein the inert gas is selected from argon, helium and mixtures thereof.

3. The process of claim 1, wherein the fixture mounting an IBR is adapted to move into and out of the chamber.

4. The process of claim 1, wherein the IR heater comprises a device for heat treating a metal component having:

at least one parabolic mirror formed in the axially extending cavity; and at least one IR heat source for providing IR heat rays in a direction toward the at least one parabolic mirror;

such that the at least one parabolic mirror is positioned to focus a band of the IR heat rays onto the metal component.

5. The process of claim 4, wherein the IR heat source and parabolic mirror are sized to direct the IR heat rays along the junction between the airfoil and the integrally bladed rotor device.

6. The process of claim 5, which includes a pair of housings on opposite sides of the entire area of contact between the airfoil and the integrally bladed rotor device, with each housing having an IR heat source and a parabolic mirror formed in the housing for each IR heat source.

7. The process of claim 6, wherein the IR heat rays are focused into an elongated band having a band width of from about 6 mm to about 18 mm.

8. A apparatus for heat treating selected portions of an integrally bladed rotor (IBR) having a plurality of blades, the apparatus comprising:

a fixture for mounting an IBR having a rotor engaging portion;

the fixture having an IBR being moveable into an environmental chamber;

an IR heater mounted on a heater support unit adapted to moveably mounting the heater on one of the IBR blades and removing it from the blade;

the chamber having a vent for evacuating air and adding an inert gas;

the heater support united being adapted to lift the IR heater from the blade and the fixture being adapted to index the IBR to position another blade on the IBR; and a control unit for controlling the heater support unit and the heater position on or off the IBR blade.

9. The apparatus of claim 8, wherein the inert gas is selected from argon, helium and mixtures thereof.

10. The apparatus of claim 8, wherein the IR heater comprises a device for heat treating a metal component having:

at least one parabolic mirror formed in the axially extending cavity; and at least one IR heat source for providing IR heat rays in a direction toward the at least one parabolic mirror;

such that the at least one parabolic mirror is positioned to focus a band of the IR heat rays onto the metal component.

11. The apparatus of claim 10, wherein the IR heat source and parabolic mirror are sized to direct the IR heat rays along the junction between the airfoil and the integrally bladed rotor apparatus.

12. The apparatus of claim 11, which includes a pair of housings on opposite sides of the entire area of contact between the airfoil and the integrally bladed rotor apparatus, with each housing having an IR heat source and a parabolic mirror formed in the housing for each IR heat source.

13. The apparatus of claim 12, wherein the IR heat rays are focused into an elongated band having a band width of from about 6 mm to about 18 mm.

14. A system for heat treating selected portions of an integrally bladed rotor (IBR) having a plurality of blades, the system comprising:

an IBR on a mounting fixture having a rotor engaging portion for mounting an IBR thereon;

an environmental chamber for receiving the mounting fixture having an IBR thereon, the chamber being adapted to evacuate air from the chamber and add an inert gas;

a heater support unit for attaching an IR heater on one of the IBR blades and lifting the IR heater from the blade and indexing the IBR to position another blade on the IBR;

a control unit for operating the IR heater for heat treating the blade heater and operating the heater support unit to index and heat treat all of the IBR blades.

15. The system of claim 14, wherein the inert gas is selected from argon, helium and mixtures thereof.

16. The system of claim 14, wherein the fixture is mounted on at least one track and adapted to move into and out of the chamber.

17. The system of claim 14, wherein the IR heater comprises a device for heat treating a metal component having:

at least one parabolic mirror formed in the axially extending cavity; and at least one IR heat source for providing IR heat rays in a direction toward the at least one parabolic mirror;

such that the at least one parabolic mirror is positioned to focus a band of the IR heat rays onto the metal component.

18. The system of claim 17, wherein the IR heat source and parabolic mirror are sized to direct the IR heat rays along the junction between the airfoil and the integrally bladed rotor device.

19. The system of claim 18, which includes a pair of housings on opposite sides of the entire area of contact between the airfoil and the integrally bladed rotor device, with each housing having an IR heat source and a parabolic mirror formed in the housing for each IR heat source.

20. The system of claim 19, wherein the IR heat rays are focused into an elongated band having a band width of from about 6 mm to about 18 mm.

* * * * *

UNITED STATES PATENT AND TRADEMARK OFFICE

CERTIFICATE OF CORRECTION

PATENT NO. : 8,437,628 B1
APPLICATION NO. : 13/361283
DATED : May 7, 2013
INVENTOR(S) : Wangen Lin et al.

It is certified that error appears in the above-identified patent and that said Letters Patent is hereby corrected as shown below:

In the Specification

Col. 2, Line 10
Delete "minors"
Insert --mirrors--

Col. 3, Line 21
Delete "minors"
Insert --mirrors--

Signed and Sealed this
Twenty-eighth Day of January, 2014

Michelle K. Lee

Michelle K. Lee
*Deputy Director of the United States Patent and Trademark Office*